US007981225B1

(12) United States Patent
Mehta et al.

(10) Patent No.: US 7,981,225 B1
(45) Date of Patent: Jul. 19, 2011

(54) LEAD FREE DETONATOR AND COMPOSITION

(75) Inventors: Neha Mehta, Succasunna, NJ (US); Gartumg Cheng, Edison, NJ (US); Emily A. Cordaro, Hopatcong, NJ (US); Neelam Mehta, Bel Air, MD (US); Carl Hu, Parsippany, NJ (US); Robert Lateer, Ogdensburg, NJ (US); Daniel Stec, III, Long Valley, NJ (US); Raja G. Duddu, Hackettstown, NJ (US); Paritosh R. Dave, Bridgewater, NJ (US); Kathy Yang, Roxbury, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 905 days.

(21) Appl. No.: 11/550,986

(22) Filed: Oct. 19, 2006

Related U.S. Application Data

(60) Provisional application No. 60/596,762, filed on Oct. 19, 2005.

(51) Int. Cl.

| | |
|---|---|
| ***C06B 35/00*** | (2006.01) |
| ***C06B 41/00*** | (2006.01) |
| ***C06B 31/02*** | (2006.01) |
| ***C06B 31/04*** | (2006.01) |

(52) U.S. Cl. ..... 149/35; 149/23; 149/61; 149/72

(58) Field of Classification Search ..... 149/23, 149/35, 61, 72, 109.4
See application file for complete search history.

(56) References Cited

U.S. PATENT DOCUMENTS

| | | | | |
|---|---|---|---|---|
| 1,390,378 | A | 9/1921 | Ott | |
| 2,112,974 | A * | 4/1938 | Noddin | 102/202.13 |
| 3,943,235 | A * | 3/1976 | Costain | 423/410 |
| 5,043,030 | A * | 8/1991 | Ramaswamy | 149/16 |

OTHER PUBLICATIONS

The Chemistry of Powder and Explosives; GSG & Associates, San Pedro, CA, pp. 432-436, 1972.
Properties of Explosives of Military Interest, Tomlinson, W.R., and Sheffield, O.E., TR1740, Picatinny Arsenal, Dover, NJ, pp. 72-75, 1958.
Encyclopedia of Explosives and Related Items, Fedoroff, B.T., and Sheffield, O.E., vol. 3, Part 2700, Picatinny Arsenal, Dover, NJ pp. C590-C591, 1966.

* cited by examiner

*Primary Examiner* — Jerry Lorengo
*Assistant Examiner* — Noah S Wiese
(74) *Attorney, Agent, or Firm* — Henry S. Goldfine

(57) ABSTRACT

A lead-free primer energetic composition including Cyanuric Triazide (60%), Tetracene (5%), Barium Nitrate (20%) and Antimony Trisulfide (15%) is produced. The lead-free primer energetic composition is used to construct a primary detonator including a transfer charge of Cyanuric Triazide, which produces a further initiation train that may subsequently detonate a secondary explosive, i.e., HDX, RDX, or a pyrotechnic device.

13 Claims, 2 Drawing Sheets

LEAD FREE DETONATOR AND COMPOSITION

CROSS REFERENCE TO RELATED APPLICATIONS

The application claims the benefit of U.S. Provisional Patent Application Ser. No. 60/596,762 filed 19 Oct. 2005, the entire contents of which are incorporated by reference as if set forth at length herein.

UNITED STATES GOVERNMENT INTEREST

The inventions described herein may be manufactured, used and licensed by or for the U.S. Government for U.S. Government purposes.

FEDERAL RESEARCH STATEMENT

The invention described herein may be made, used, or licensed by or for the United States Government for government purposes without payment of any royalties thereon or therefore.

FIELD OF THE INVENTION

This invention relates generally to the field of energetic materials including explosives and propellants. More particularly, it pertains to a lead-free composition and detonator constructed therefrom—for detonating energetic materials.

BACKGROUND OF THE INVENTION

Primary detonators (a.k.a. primers) are widely employed in a variety of application areas to initiate the explosion of a more powerful secondary explosive such as may be found for example, in ammunitions, artillery shells, high explosives or fireworks. Common primers produce this explosive initiation through the effect of an energetic material or energetic mixtures that are responsive to a mechanical or other stimulus. When placed adjacent to or within a secondary explosive, energy produced by detonation of the primer causes the secondary explosive to detonate.

Common primer energetic materials all contain lead i.e., lead azide, lead styphnate, etc. For example, NOL-130 a commonly used energetic mixture used in primers, contains lead styphnate, and lead azide along with barium nitrate, antimony sulfide and tetracene.

While such energetic materials effectively initiate the detonation of secondary explosives, the use and manufacture of lead-based materials pose acute and chronic toxicity hazards during their preparation, production and beyond—including later in the life cycle of an item containing such lead-based materials after that item has been field functioned.

SUMMARY OF THE INVENTION

In accordance with a first aspect of the instant invention, a lead-free primer energetic composition including Cyanuric Triazide (60%), Tetracene (5%), Barium Nitrate (20%) and Antimony Trisulfide (15%) is produced.

In accordance with another aspect of the instant invention, the lead-free primer energetic composition is used to construct a primary detonator including a transfer charge of Cyanuric Triazide, which produces a further initiation train that may subsequently detonate a secondary explosive, i.e., HDX, RDX, or a pyrotechnic device.

BRIEF DESCRIPTION OF THE DRAWING

Particular features and aspects may be understood with reference to the drawing in which.

DETAILED DESCRIPTION

The following merely illustrates the principles of the invention. It will thus be appreciated that those skilled in the art will be able to devise various arrangements which, although not explicitly described or shown herein, embody the principles of the invention and are included within its spirit and scope.

Furthermore, all examples and conditional language recited herein are principally intended expressly to be only for pedagogical purposes to aid the reader in understanding the principles of the invention and the concepts contributed by the inventor(s) to furthering the art, and are to be construed as being without limitation to such specifically recited examples and conditions.

Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Thus, for example, it will be appreciated by those skilled in the art that the diagrams herein represent conceptual views of illustrative structures embodying the principles of the invention.

Figure 1A:
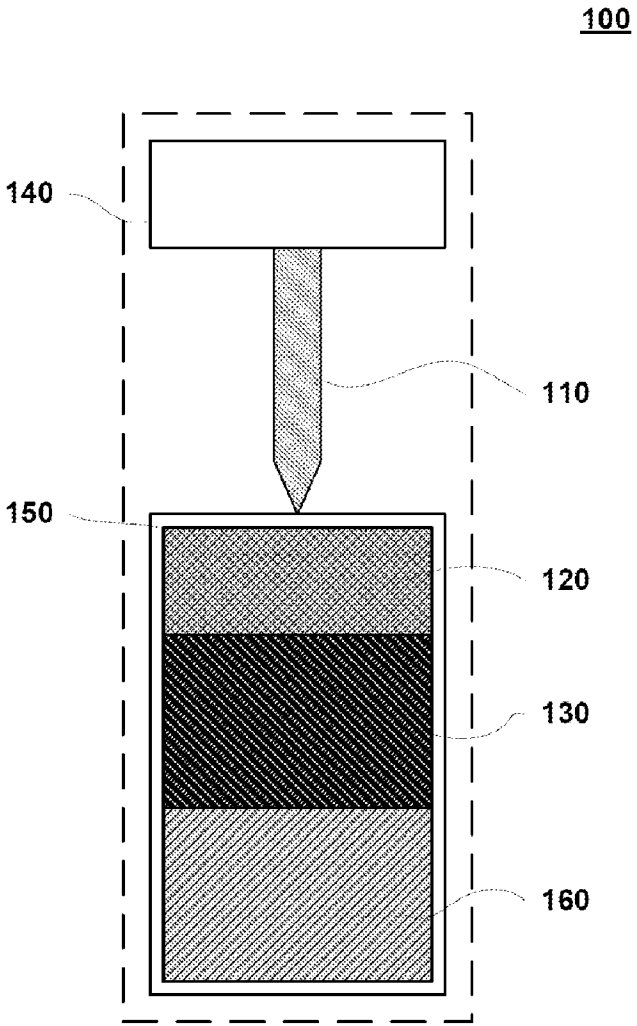
FIG. 1A depicts a schematic diagram of a stab-detonator assembly prior to firing, according to the present invention.
Figure 1B:
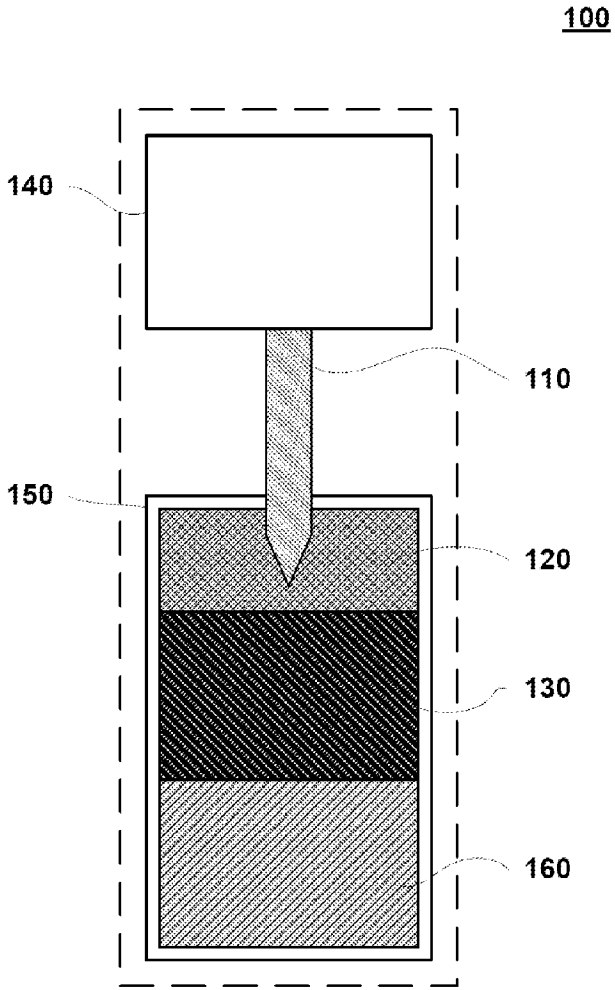
FIG. 1B depicts a schematic diagram of the stab-detonator assembly of FIG. 1A during firing, according to the present invention.

FIGS. 1A and 1B are schematic diagrams of a stab-detonator assembly showing a pre-firing and firing configuration, respectively. As can be readily appreciated by those skilled in the art, stab-detonators such as the ones shown are widely used to activate a wide variety of medium caliber munitions (20-60 mm) among others.

Turning now to FIG. 1A, shown therein is a stab-detonator assembly 100 generally comprising a firing pin 110, a primer charge 120 and a transfer charge 130. The primer charge 120 is an energetic composition (or mixture) that is sensitive to mechanical stimulus. Similarly, the transfer charge 130 is sensitive to a stimulus produced when the primer charge 120 detonates.

Operationally, and with reference now to FIG. 1B, the firing pin 110 is driven by a gas or mechanical actuation mechanism 140. When so driven, the firing pin 110 is forced through a detonator case 150 and into the primer charge 120.

Rapid heating caused by the resulting compression and friction of the firing pin 110 driven into the primer charge 120 results in its initiation. The resulting rapid decomposition of the primer charge 120 generates a pressure/temperature pulse that is sufficient to stimulate the detonation of the transfer charge 130.

The detonation of the transfer charge 130 produces sufficient output energy to detonate a secondary (main) explosive, such as a high-explosive, propellant, or pyrotechnic 160. In a conventional stab detonator, the transfer charge 130 comprises Lead Azide which —as already noted—is particularly hazardous and therefore undesirable.

According to one aspect of the invention, a lead-free primer charge 110 is employed in the detonator assembly. This lead-free primer charge composition comprises: Cyanuric Triazide (~60% by weight), Tetracene, a.k.a. 4-guanyl-1-(alpha-tetrazol-5yl) tetrazene or guanyldiazoguanyl tetrazene (~5% by weight), Barium Nitrate —$Ba(NO_3)_2$-(~20% by weight) and Antimony Trisulfide —$Sb_2S_3$ or $Sb_4S_6$— (~15% by weight). Advantageously, Cyanuric Triazide (2,4,6-triazido-1,3,5-triazine) is a known energetic material exhibiting high impact and friction sensitivity. As can be observed from its chemical formula, it contains only carbon and nitrogen atoms. Additionally, Tetracene, a.k.a. 4-guanyl-1-(alpha-tetrazol-5yl) tetrazene or guanyldiazoguanyl tetrazene, is also a lead-free compound.

Of particular importance, Cyanuric Triazide is thermally stable, exhibiting a decomposition of ~187° C. and may be readily prepared by any of a number of known methods. Preparation of the lead-free primer charge according to the present invention requires the combination of the Cyanuric Triazide with the remaining compounds listed above—substantially in the amounts described. Advantageously, as the components are all substantially dry powders, the preparation may be conducted by placing the components in a drum tumbler and mixing for a suitable period of time, i.e., 30 minutes.

Those skilled in the art will recognize a number of the compounds employed in the present invention and in particular Cyanuric Triazide which has been characterized extensively. (See., e.g, Tomlinson, W. R., Jr.; Sheffield, O. E. "Properties of Explosives of Military Interest" TR 1740, Picatinny Arsenal, Dover, N. J. April 1958. pp. 72-75; Fedoroff, B. T.; Sheffield. O. E. "Encyclopedia of Explosives and Related Items", Volume 3, PATR 2700, Picatinny Arsenal, N. J., 1966: pp. C590-0591; Ott, E. U.S. Pat. No. 1,390,378 "Explosive and Process of Making Same: Sep. 13, 1921; Davis, T. L. "The Chemistry of Powder and Explosives". GSG & Associates, San Pedro, Calif.: 1972, pp. 432-436). Some exemplary preparations of the Cyanuric Triazide and the lead-free primer charge are provided as follows.

Example 1

Cyanuric triazide (2 grams) was dissolved in acetone (20 mL) at ambient temperature. The solution was poured in a steady stream into water (200 mL), stirred at a temperature of 3-5° C. The precipitated solids were suction filtered and dried at 38-45° C.

Example 2

Cyanuric triazide (2 grams) was dissolved in acetone (20 mL) at ambient temperature. The solution was added to a disposable syringe, with disposable needle attached. The solution was injected over a 30-60 second period from a height of 2-6 inches into water (200 mL), stirred at a temperature of 3-5° C. The precipitated solids were suction filtered and dried at 38-45° C.

Example 3

Cyanuric triazide (1.96 grams) was dissolved in acetone (20 mL) at ambient temperature. The solution was added to a disposable syringe, with disposable needle attached. The solution was injected over a 30-60 second period from a height of 2-6 inches into water (200 mL), stirred at a temperature of 3-5° C. A solution of ethyl cellulose (0.04 grams) in acetone (10 mL.) was added to a disposable syringe, with disposable needle attached. The solution was injected over a 15-30 second period from a height of 2-6 inches into the water slurry. The precipitated solids were suction filtered and dried at 38-45° C.

Example 4

Cyanuric triazide (1.98 grams) was dissolved in a solution of ethyl cellulose (0.02 grams) dissolve in acetone (20 mL) at ambient temperature. The solution was added to a disposable syringe, with disposable needle attached. The solution was injected over a 30-60 second period from a height of 2-6 inches into water (200 mL), stirred at a temperature of 3-5° C. The precipitated solids were suction filtered and dried at 38-45° C.

Example 5

The following dry materials, cyanuric triazide (6.0 grams), tetracene (0.5 grams), barium nitrate (2.0 grams), and antimony trisulfide (1.5 grams), was placed in a conductive container and sealed. The container was placed in a drum tumbler and mixed for 30 minutes.

According to the present invention, the transfer charge 130 is a quantity of Cyanuric Triazide. In this inventive manner, an entire primer initiating train including a primary charge and a transfer charge is lead-free.

While not specifically shown in the figure—but as can be readily appreciated by those skilled in the art—upon firing, a primer assembly such as that shown in FIG. 1A and FIG. 1B, when positioned within or sufficiently close to an explosive (or pyrotechnic) material will initiate the further detonation of the explosive.

It is to be understood that the above-described embodiments are merely illustrative of the instant invention and that many variations of the above-described embodiments can be devised by those skilled in the art without departing from the scope of the invention. For example, in this Disclosure, numerous specific details are provided in order to provide a thorough description and understanding of the illustrative embodiments of the instant invention. Those skilled in the art will recognize, however, that the invention can be practiced without one or more of those details, or with other methods, materials, components, etc.

What is claimed is:

1. A lead-free primer charge energetic composition comprising:

Cyanuric Triazide—substantially 60% by weight, Tetracene—substantially 5% by weight, Barium Nitrate—substantially 20% by weight, and Antimony Trisulfide—substantially 15% by weight;

which charge is activated by a stab-detonation.

2. The primer charge energetic composition of claim 1 wherein said

Antimony Trisulfide includes $Sb_2S_3$.

3. A lead-free primer assembly comprising:

a primer charge consisting of a quantity of the lead-free primer energetic composition according to claim 1;

a firing pin; and an activator for forcing the firing pin into the lead-free energetic composition;

such that the primer charge ignites when the firing pin is forced into it thereby releasing a quantity of energy.

4. The lead-free primer assembly of claim 3 further comprising:

a lead-free transfer charge which detonates as a result of the energy released by primer charge ignition.

5. The lead-free primer assembly of claim 4 wherein said transfer charge consists of Cyanuric Triazide.

6. The primer charge energetic composition of claim 3 wherein said Antimony Trisulfide includes $Sb_2S_3$.

7. The primer charge energetic composition of claim 3 wherein said Antimony Trisulfide includes $Sb_4S_6$.

8. The primer assembly of claim 3 further comprising a quantity of secondary explosive which is sensitive to and detonates in response to a shock wave produced by the detonation of the transfer charge.

9. The primer assembly of claim 6 wherein said secondary explosive is one chosen from the group consisting of: high explosives and pyrotechnics.

10. A method of detonating a quantity of secondary explosive comprising the steps of:

igniting a quantity of the lead-free primary charge energetic composition according to claim 1; and detonating a quantity of lead-free transfer charge in response to the ignition of the primary charge;

such that a sufficient amount of energy is produced from the transfer charge detonation to detonate the secondary explosive.

11. The method of claim 10 wherein said Antimony Trisulfide includes $Sb_2S_3$.

12. The method of claim 10 wherein said Antimony Trisulfide includes $Sb_4S_6$.

13. The method of claim 10 wherein said transfer charge consists of Cyanuric Triazide.

* * * * *